United States Patent [19]

Harner et al.

[11] Patent Number: 5,066,886

[45] Date of Patent: Nov. 19, 1991

[54] THERMALLY RESPONSIVE ARTICLE, METHOD OF MAKING SAME, AND A DEVICE INCORPORATAING SAID ARTICLE

[75] Inventors: Leslie L. Harner, Ruscombmanor Township, Berks County; Earl L. Frantz, Reading, both of Pa.

[73] Assignee: Carpenter Technology Corporation, Reading, Pa.

[21] Appl. No.: 429,711

[22] Filed: Oct. 31, 1989

[51] Int. Cl.[5] ..... H01J 29/80

[52] U.S. Cl. ..... 313/404; 313/405; 313/406

[58] Field of Search ..... 313/404, 405, 406, 292; 428/617, 619; 148/902

[56] References Cited

U.S. PATENT DOCUMENTS

| | | | |
|---|---|---|---|
| 3,330,980 | 7/1967 | Shrader | 313/405 |
| 3,370,192 | 2/1968 | Schwartz et al. | 313/404 |
| 3,524,972 | 8/1970 | Cooper et al. | 313/405 |
| 3,524,973 | 8/1970 | Rigdon | 313/405 |
| 3,524,974 | 8/1970 | Kautz | 313/405 |
| 3,573,527 | 4/1971 | Hafkenscheid et al. | 313/405 |
| 3,617,787 | 11/1971 | Plukker | 313/405 |
| 3,639,798 | 2/1972 | Miller | 313/405 |
| 3,678,757 | 7/1972 | Snyder | 394/207 |
| 3,700,948 | 10/1972 | Palac | 313/405 |
| 3,743,485 | 7/1973 | Gottlieb et al. | 428/619 |
| 3,754,157 | 8/1973 | Yamazaki et al. | 313/405 |
| 3,823,336 | 7/1974 | Nakamura et al. | 313/405 |
| 3,832,148 | 8/1974 | Gottlieb et al. | 428/619 |
| 3,838,985 | 10/1974 | Ornstein | 428/617 |
| 3,898,508 | 8/1975 | Pappadis | 313/408 |
| 4,491,763 | 1/1985 | Fujinuma et al. | 313/406 |
| 4,524,298 | 6/1985 | Pawlikowski et al. | 313/298 |
| 4,844,752 | 7/1989 | Bear | 148/150 |
| 4,950,943 | 8/1990 | Ito | 313/404 |

OTHER PUBLICATIONS

*Standard Specification for Thermostat Component Alloys*, ASTM Designation: B753-86, American Society for Testing and Materials, Philadelphia, Pennsylvania (Mar. 1986).

Alloy Digest Data Sheet for "Temperature Compensator 30 & 32", Engineering Alloys Digest, Inc., Upper Montclair, New Jersey (Oct., 1957).

*Primary Examiner*—Donald J. Yusko
*Assistant Examiner*—Diab Hamadi
*Attorney, Agent, or Firm*—Dann, Dorfman, Herrell and Skillman

[57] ABSTRACT

A thermally respective, monometallic article is isclosed which obviates the need for bonding of dissimilar metals as in a bimetal. The thermally responsive article is formed of an alloy or a metal and has at least two portions. The two portions are characterized by different coefficients of thermal expansion over a given temperature range, the difference being sufficiently large to result in deflection of the article when heated or cooled. In the preferred form of the article, the alloy or metal is present in a first phase in one portion of the article and in a second phase in the other portion. The process for obtaining the dual phase arrangement includes subjecting one portion of an intermediate form to cold treatment, cold reduction, decarburization, or a combination thereof, depending on the material used. A cathode ray tube employing the thermally responsive article as a temperature compensating device is also disclosed.

14 Claims, 1 Drawing Sheet

THERMALLY RESPONSIVE ARTICLE, METHOD OF MAKING SAME, AND A DEVICE INCORPORATAING SAID ARTICLE

BACKGROUND OF THE INVENTION

This invention relates to an article that deflects in response to a change in its temperature and more particularly to such an article that is formed of a monometallic material, a method for making same, and a cathode ray tube incorporating such an article.

Thermally responsive articles such as found in thermostats and other thermally controlled devices, and, in particular, deflection springs used in color television cathode ray tubes, are known, formed of at least two different alloys bonded together, and are referred to as bimetals or bimetallic articles. The alloys used in a bimetallic article have dissimilar expansion properties in order for the bimetallic article to be operative, for example, by deflecting, when its temperature changes. An advantage in the manufacturing of such thermally responsive articles could be realized if such articles were made without the need to bond together dissimilar alloys.

The combination of thermal and mechanical stresses on the known bimetallic article, in some uses, can exceed the elastic limit of the alloys from which the article is made. When the elastic limit is exceeded, the article takes on a permanent set by deforming plastically. Such a permanent set interferes with the calibration or operation of the device in which the article is employed. Accordingly, a further advantage would be realized if a thermally responsive article could be made from higher strength material than presently used.

SUMMARY OF THE INVENTION

It is a principal object of this invention to provide a monometallic, thermally responsive article that exhibits controlled displacement in response to a given change in its temperature.

Another object of this invention is to provide such an article having higher elastic properties than known bimetallic, thermally responsive articles.

A further object of this invention is to provide a method for making such a thermally responsive article which does not require bonding together of dissimilar metals in order to obtain thermal responsiveness.

A still further object of this invention is to provide a cathode ray tube for a color television or color monitor which incorporates a monometallic, thermally responsive article.

The foregoing objectives, as well as other advantages, are achieved in accordance with a preferred embodiment of the present invention by providing a thermally responsive, monometallic article which functions essentially the same as a bimetal in response to an increase or a decrease in temperature over a predetermined temperature range. The article provides a predetermined displacement, for example, as by deflection, corresponding to a given temperature in the range.

In accordance with another feature of the present invention, there is provided a preferred method for making the thermally responsive, monometallic article in which a metallic member is thermally or mechanically processed so that one portion of the article has a predetermined coefficient of thermal expansion (COE) over the temperature range of interest while another portion has a different COE over the same range. The differences between the COE's of the respective portions are such that the thermally responsive article provides the desired displacement for a temperature change within the predetermined temperature range.

In accordance with a further feature of this invention a cathode ray tube for a color television or color monitor is provided which includes a faceplate and a multi-apertured shadow mask disposed at a preselected radial distance inside the cathode ray tube from the faceplate. A thermally responsive, monometallic element positions the shadow mask in the cathode ray tube and maintains the shadow mask substantially at the preselected distance from the faceplate during temperature cycling of the cathode ray tube.

BRIEF DESCRIPTION OF THE DRAWINGS

Further objects as well as advantages of the present invention will be apparent from the following detailed description of the invention and the accompanying drawings wherein.

DETAILED DESCRIPTION

Figure 1:
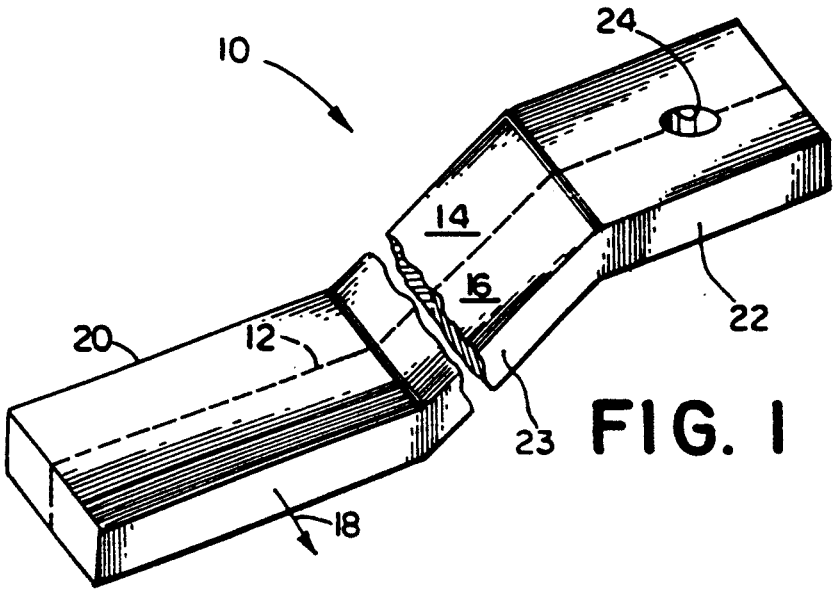
FIG. 1 is a perspective view, partially cut-away, of a thermally responsive article according to one feature of the present invention.

Referring now to the drawings wherein like reference numerals refer to the same or similar elements in the various figures, and in particular to FIG. 1, there is shown a preferred embodiment of a thermally responsive article 10 according to the present invention. The thermally responsive article 10 is divided along a longitudinal boundary line or axis 12 into a first portion 14 and a second portion 16. The second portion 16 of the article is characterized by a COE that is different from and preferably lower than the COE of the first portion 14 over a preselected temperature range. Article 10 is made from a monometallic material, preferably a single alloy, which, in portion 14, is in a first or metastable phase and in portion 16 is in a second phase. The difference in the two COE's over the selected temperature range is great enough to cause article 10 to deflect transversely relative to its long axis when its temperature changes. In the embodiment shown, article 10 would deflect in the direction of arrow 18 when its temperature increases and in the opposite direction when its temperature decreases. Thus, in operation, the thermally responsive article 10 functions in a manner similar to the known thermally responsive bimetal.

As shown in FIG. 1, the article 10 is in the form of an elongated, monometallic deflection spring having a first end portion 20 and a second end portion 22. End portions 20 and 22 can be offset in mutually parallel planes by an intermediate section 23 as shown more clearly in FIG. 2. Although article 10 has been described in terms of the form shown in FIG. 1, other forms can be made, e.g., one with a single bend or with no bends at all, depending on the desired use for the article.

A hole 24 can be formed in end portion 22 for receiving a stud, pin, bolt, or other fastener for attaching and anchoring end portion 22 of article 10 in a desired location. End portion 20 can be fastened in a similar manner, or by more permanent means such as welding, to an object that is movable relative to the location of attachment of end portion 22.

The preferred material for making an article according to the present invention is an elemental metal or an alloy that is capable of existing in at least two phases at a temperature within the desired temperature range for a particular use. The two phases should have different COE's relative to each other, preferably, a sufficiently large difference between COE's over the desired temperature range to provide a desired amount of deflection in the article when it is heated or cooled. A suitable material has a metastable phase which can be readily transformed to another phase having a sufficiently different coefficient of thermal expansion from that of the metastable phase. Preferably, the material is of the type having an austenitic, face centered cubic structure which can be readily transformed to a martensitic body centered structure, such as a body centered cubic structure. Another characteristic of the preferred metal or alloy is a martensite start temperature, $M_s$ temperature, below room temperature.

Known grades of austenitic and semi-austenitic stainless steels, for example AISI Type 201 or Type 304 stainless steels, are suitable for use in the article according to this invention. Another type of alloy suitable for use in the article according to the present invention is the controlled expansion alloy defined in ASTM Spec. B753-86 (March 1986), for example, alloy T-22 in Table I therein. Such an alloy is particularly suitable for use where better elastic properties are desired. For example, a higher modulus of elasticity is preferred when high stiffness is desired, whereas a high elastic limit is preferred when it is desired to prevent the article from taking on a permanent set when subjected to high mechanical stress. A further example of a suitable alloy is the so-called "temperature-permeability alloy", which is a magnetic alloy whose permeability changes with temperature. As indicated above, an elemental metal, such as iron, that can be made to transform, can also be used in the article according to the present invention.

The article according to the present invention can be formed by different methods. The preferred starting form of the article is a bar or strip in which the selected alloy is in its metastable phase. A longitudinal portion, preferably one-half, of the strip or bar is processed to effect transformation from the metastable phase to the other phase, for example, from an austenitic phase to a martensitic phase. The preferred methods of effecting transformation in austenitic alloys include cold treatment, decarburization, cold working, or a combination thereof. When the article is formed of a semi-austenitic alloy, transformation is preferably effected by a precipitation heat treatment and cooling.

It is recognized that although the article according to the present invention is preferably made from wrought metallic material, it can be made using other techniques. For example, cast metallic material as well as material prepared by powder metallurgy techniques can be used.

Cold treatment is preferred when the material has an $M_s$ temperature below room temperature. Transformation of the metastable austenitic phase to the martensitic phase is effected by immersing a portion of an intermediate form of the metal or alloy in a cold medium, such as liquid nitrogen or a mixture of dry ice and methanol, that is at or below the $M_s$ temperature of the material, while maintaining the other portion above the $M_s$ temperature. For example, a continuous thin strip of suitable material could be drawn over a rotating metal drum containing liquid nitrogen or between a pair of such drums such that only half of the width of the strip is in contact with the drum. The other half-width would be maintained above the $M_s$ temperature by adjusting the speed of the strip passing over the drum or by contacting another drum adapted to function as a heat sink.

Decarburization is another method of effecting the martensitic transformation because removal of carbon from the matrix of a metastable alloy raises the $M_s$ temperature of the alloy. If sufficient carbon is removed from the alloy matrix the $M_s$ temperature can be raised to near room temperature. Decarburization can be implemented by treating one portion of the article at elevated temperature in an oxidizing or reducing atmosphere. In order to prevent decarburization of the other portion of the article it can be masked for example, as by application of a coating thereto, before decarburization heat treatment of the article.

The precipitation of austenite stabilizers in semi-austenitic stainless steel alloys during precipitation heat treatment effects removal of carbon and chromium from the alloy matrix to form chromium carbides. When sufficient quantities of carbon and chromium are removed from the matrix the stability of the austenite is reduced, thereby lowering the $M_s$ temperature, and the martensite transformation can occur on cooling to room temperature or can be readily induced, e.g., by cold treatment. To form an article according to the present invention one side of a strip of such a semi-austenitic alloy would be heat treated at a temperature to cause chromium-carbide precipitation and then quenched to a temperature not higher than the adjusted $M_s$ temperature, while the other side would be held at a lower temperature to prevent precipitation in that portion. For example, a continuous thin strip of a semi-austenitic alloy in the austenitic condition could be drawn through a focussed beam of radiant heat, such as infrared radiation, having a beam-width of about half the width of the strip. The heat beam is adjusted in intensity to heat the half-width of the strip to a temperature in a range wherein carbide precipitation occurs. The other half-width is maintained at a lower temperature by contacting a drum containing a cooling medium, such as water. The entire strip width would then be cooled to below the adjusted $M_s$ temperature of the heated portion.

Stress induced martensitic transformation in a metastable alloy can occur during a cold working operation such as cold drawing or cold rolling. A preferred method for making the article according to the present invention by cold working includes making an intermediate form by working an ingot or billet into bar having a wedge-shaped or L-shaped transverse cross-section. The intermediate form is then drawn or rolled to form a flat strip having a substantially uniform, transverse cross-section. The thicker side of the intermediate form must receive an amount of reduction sufficient to effect martensitic transformation of the material in that portion. Thus, the formerly thick part of the strip would be transformed whereas the other part would not.

Although it is preferred that the article according to the present invention be formed from a single piece of the appropriate alloy or metal, an article according to this invention can also be formed by bonding together a piece of untransformed alloy and a piece of transformed alloy, such as by welding, roll bonding, etc.

The above-described processes for making an article in accordance with the present invention can be used individually or in combination to produce the desired transformation in the article. It should be noted, however, that other processes may be employed as well. For example, when the article is made from an alloy having an $M_s$ temperature below room temperature, the entire article can be transformed to the martensitic phase and then a portion of the article can be heated to re-austenitize the material in that portion while the martensitic portion would be held at a lower temperature to prevent re-austenitization. One method of re-austenitizing the material is by A.C. induction heating of the article. The depth of heating can be controlled by the frequency of the induction current.

Preferably, the transformed side of the article is fully transformed in order to provide a uniform differential in expansion characteristics between the transformed and the untransformed portions. However, a partially transformed structure can be used with good results if the distribution of transformed material is substantially uniform throughout the partially transformed portion of the article.

While it is preferred that the volume ratio of transformed material to untransformed material in the article according to the present invention be about 50/50, many other ratios can provide useful results. The limits on the actual ratio employed depends on the design of the particular article. For example, an article which does not have a design limitation on length could be made with a smaller differential expansion characteristic, i.e., a ratio of less than 50/50 transformed to untransformed phase. Whereas an article having a design limitation on length would require a higher differential expansion and thus a ratio closer to 50/50.

It will be appreciated that the article according to the present invention can be clad or coated with a second metallic material. For example, where the article is to be used as part of an electric circuit it can be clad with a highly conductive metallic material. In other uses, the article can be coated or clad with an anti-corrosion material.

Figure 2:
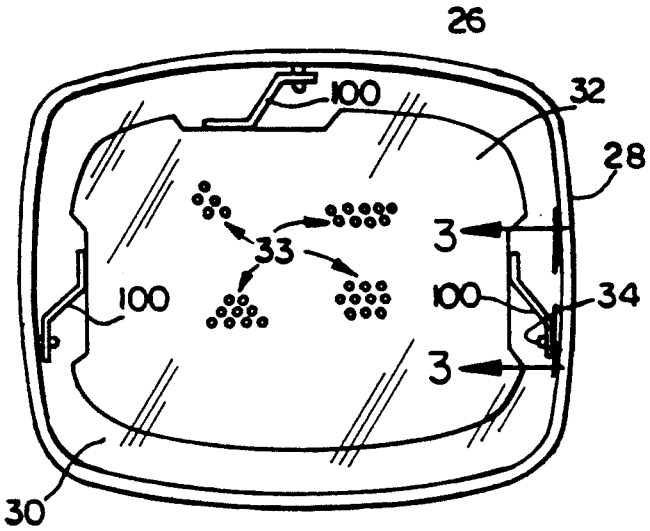
FIG. 2 is a front elevational view of a cathode ray tube for a color television or monitor according to another feature of the present invention.
Figure 3:
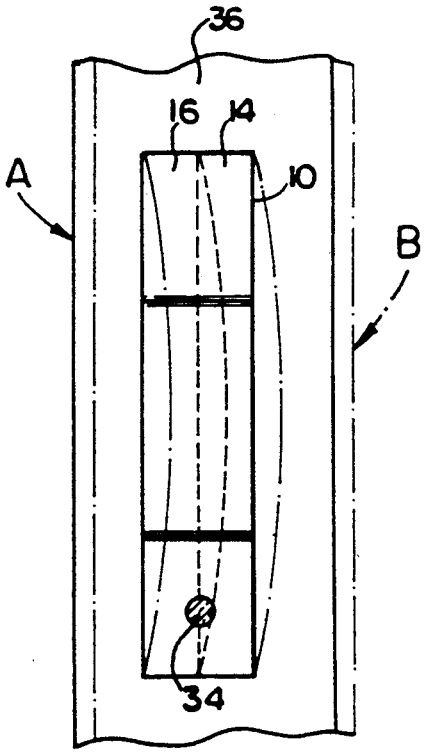
FIG. 3 is a partial sectional view through the line 3—3 of FIG. 2.

Referring now to FIG. 2 there is shown a cathode ray tube (CRT) 26 for a color television or color monitor. The CRT 26 includes an envelope 28 and a faceplate 30. A shadow mask 32 having a plurality of apertures 33 is mounted in CRT 26 at a preselected radial distance from faceplate 30. The shadow mask 32 is held in place by a plurality of deflection springs 10. Although three deflection springs are shown in FIG. 2, more or fewer can be used as desired. The deflection spring 10 is affixed at one end portion to the envelope 28 of CRT 26 by a fastener such as a stud or pin 34 extending from the envelope 28 through hole 24. The other end portion of deflection spring 10 is affixed to the frame 36 of shadow mask 32 as shown in FIG. 3. As is well known in the art, temperature cycling of the CRT 26, for example, during initial warm-up, unless compensated for, causes misregistration of the mask apertures 33 with color phosphors on the faceplate 30 because of movement of the shadow mask 32 from a position A to a position B, for example. However, the deflection springs 10, being in good heat exchange relation with the shadow mask 32 and having portions with different COE's as described hereinabove, deflect and thereby function to maintain the shadow mask 32 substantially at the preselected radial distance from face plate 30.

It can be seen from the foregoing description that the present invention provides a thermally responsive, monometallic article which is made without the need for bonding dissimilar metals together. Furthermore, the preferred method for making the thermally responsive article includes thermal and/or mechanical processing of an intermediate form of the monometallic material to effect transformation of one portion thereof whereby the transformed and untransformed portions have different COE's over the operative temperature range of the article. Additionally, an improved CRT for a color television or color monitor has been described which employs such a thermally responsive, monometallic element to maintain a shadow mask in proper registration with the color phosphors on the CRT faceplate.

The terms and expressions which have been employed are used as terms of description and not of limitation. There is no intention in the use of such terms and expressions of excluding any equivalents of the features shown and described, or portions thereof. It is recognized, however, that various modifications are possible within the scope of the invention claimed.

What is claimed is:

1. A monometallic, thermally responsive article that provides controlled displacement corresponding to a given temperature in a predetermined temperature range, said article comprising first and second portions formed of the same material and having a first phase in said first portion characterized by a first coefficient of thermal expansion and a second phase in said second portion characterized by a second coefficient of thermal expansion, whereby said first portion has a first coefficient of thermal expansion over said temperature range and said second portion has a second coefficient of thermal expansion different from said first coefficient over said temperature range.

2. A thermally responsive, monometallic article that deflects in response to a change in its temperature, said article being formed of a metallic material having first and second phases, said first phase being characterized by a first coefficient of thermal expansion over a predetermined temperature range and said second phase being characterized by a second coefficient of thermal expansion different from said first coefficient over said temperature range, said article comprising a first portion wherein said metallic material is in the first phase and a second portion wherein said metallic material has been at least partially transformed to the second phase.

3. An article as set forth in claim 2 wherein the first coefficient of thermal expansion is greater than the second coefficient of thermal expansion.

4. An article as set forth in claim 2 wherein the difference between said first and second coefficients of thermal expansion is such as to cause said article to deflect when its temperature is changed.

5. An article as set forth in claim 4 wherein said first portion and said second portion are dimensioned and aligned relative to each other such that said article deflects when its temperature is changed.

6. An article as set forth in claim 2 wherein said first and second phases of the material are juxtaposed such that said article is deflected with respect to its longitudinal axis when its temperature is changed.

7. An article as set forth in claim 2 wherein the material from which the article is formed is an alloy.

8. An article as set forth in claim 2 wherein said second portion is substantially completely transformed to the second phase.

9. An article as set forth in claim 2 wherein said first phase consists essentially of metastable austenite.

10. An article as set forth in claim 9 wherein said second phase consists essentially of martensite.

11. An article as set forth in claim 2 wherein said first phase has a metastable, face-centered-cubic crystal structure and said second phase has a body centered crystal structure.

12. An article as set forth in claim 10 wherein said second phase has a body-centered cubic crystal structure.

13. An article as set forth in claim 2 wherein said material is transformed substantially across the thickness of said second portion.

14. A cathode ray tube comprising:

a vacuum envelope including a faceplate;

a multi-apertured shadow mask disposed a preselected radial distance inside the cathode ray tube from the faceplate; and a thermally responsive, monometallic element for mounting said shadow mask in said envelope and for maintaining said shadow mask substantially at said preselected radial distance from the faceplate during temperature cycling of the cathode ray tube, said thermally responsive, monometallic element having first and second portions formed of an alloy having a first phase in said first portion which is characterized by a first coefficient of thermal expansion over a predetermined temperature range and a second phase in said second portion which is characterized by a second coefficient of thermal expansion over said temperature range, whereby said first portion has a first coefficient of thermal expansion and said second portion has a second coefficient of thermal expansion different from said first coefficient.

* * * * *